United States Patent [19]

Stern et al.

[11] Patent Number: 4,517,536

[45] Date of Patent: May 14, 1985

[54] LOW LOSS DIELECTRIC WAVEGUIDE JOINT AND METHOD OF FORMING SAME

[75] Inventors: Richard A. Stern, Allenwood; Richard W. Babbitt, Fair Haven, both of N.J.

[73] Assignee: The United States of America as represented by the Secretary of the Army, Washington, D.C.

[21] Appl. No.: 426,504

[22] Filed: Sep. 29, 1982

[51] Int. Cl.[3] ..... H01P 1/04; B65H 69/02

[52] U.S. Cl. ..... 333/254; 29/600; 156/158; 156/304.2

[58] Field of Search ..... 156/158, 304.2; 333/239, 248, 237, 254; 29/600; 106/DIG. 5; 501/137; 252/520; 343/862

[56] References Cited

U.S. PATENT DOCUMENTS

| | | | |
|---|---|---|---|
| 2,689,186 | 9/1954 | Day | 106/DIG. 5 |
| 3,315,186 | 4/1967 | Rosler et al. | 333/239 |
| 3,537,043 | 10/1970 | Smith | 333/254 |
| 3,717,487 | 2/1973 | Hurley | 501/137 |
| 3,928,102 | 12/1975 | Rowe et al. | 156/158 |
| 4,186,998 | 2/1980 | Holzman | 350/DIG. 21 |

FOREIGN PATENT DOCUMENTS

| | | | |
|---|---|---|---|
| 21613 | 2/1980 | Japan | 333/239 |
| 104012 | 8/1980 | Japan | 501/137 |

OTHER PUBLICATIONS

The International Dictionary of Physics and Electronics, 2nd Ed., Van Nostrand Com., Inc., 1961, p. 731.

New Microwave, Electronics, Oct. 18, 1965, p. 173.

"Industrial Ceramics", F. Singer et al., C 1963, Chemical Publishing Co., Inc., pp. 155–157.

*Primary Examiner*—Michael Ball

*Attorney, Agent, or Firm*—Anthony T. Lane; Jeremiah G. Murray; Roy E. Gordon

[57] ABSTRACT

The air gap in the joints between millimeter wavelength, dielectric waveguide circuit components is filled with a slurry made from an inorganic dielectric, such as barium titanate; and an organic binder, such as cellulose nitrate. The proportions of the dielectric and binder are taken so as to have a composite dielectric constant the same as that of the components being joined. This removes breaks or discontinuities and in turn reduces the insertion loss at the joints.

7 Claims, 3 Drawing Figures

LOW LOSS DIELECTRIC WAVEGUIDE JOINT AND METHOD OF FORMING SAME

The invention described herein may be manufactured, used and licensed by or for the Government for Governmental purposes without the payment to me of any royalties thereon.

BACKGROUND OF THE INVENTION

This invention relates generally to millimeter wavelength, electromagnetic energy, dielectric waveguide transmission lines, and more particularly to a low loss joint for such dielectric waveguides.

In the fabrication of dielectric waveguide circuits, numerous butt joints exist between the dielectric waveguides, control devices, bends and other transmission line elements. In the transmission of millimeter wavelength energy through these joints, any air gap or void causes detrimental energy losses by radiation and/or reflection of energy.

Previously, an attempt was made to reduce such losses by minimizing the gap at each butt joint by carefully configuring the mating parts; however, this technique proved to be very costly and energy loss persisted.

It is therefore an object of this invention to reduce energy losses by radiation and/or reflection of energy in butt joints between dielectric waveguide circuit elements.

SUMMARY OF THE INVENTION

The gap in the butt joint between dielectric waveguide circuit elements is filled with a low loss slurry of a dielectric and binder. This slurry is then dried or cured. The proportions of the dielectric and binder are selected so as to have a composite dielectric constant the same as, or as close as possible to, that of the dielectric waveguide material.

DESCRIPTION OF THE PREFERRED EMBODIMENT

Figure 1:
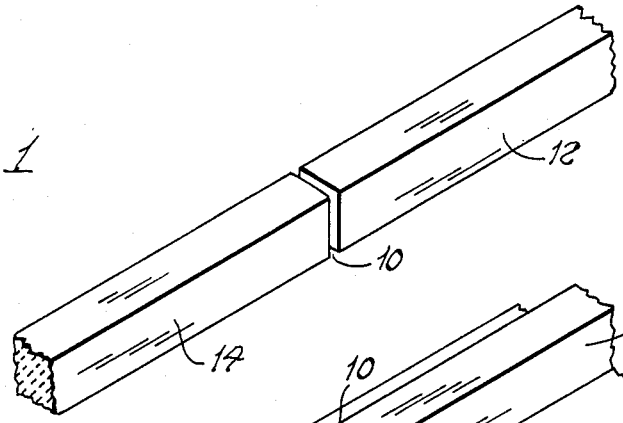
FIG. 1 represents schematically two dielectric waveguides having a joint between them.

FIG. 1 represents a joint 10 between two millimeter wavelength, dielectric waveguide components 12 and 14. Typically, in the millimeter wavelength frequency region of 26 GHz to 100 GHz, components 12 and 14 have cross-sectional dimensions on the order of 0.05 cm to 0.2 cm (the smaller dimension being associated with the higher frequency). Using conventional techniques for forming the dielectric waveguide components, an air gap or void will remain at the joint which may be from as little as $2\times10^{-3}$ cm up to about $15\times10^{-3}$ cm (0.001–0.006 inches). Filling the joint with a conventional epoxy adhesive or the like does not effectively decrease radiation and/or reflective loss.

Figure 2:
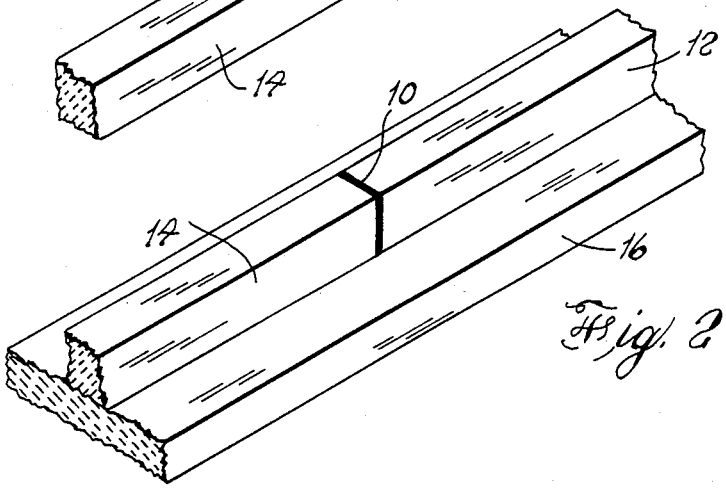
FIG. 2 represents the waveguides of FIG. 1 with the low loss joint of this invention.

In accordance with the invention and as shown in FIG. 2, the gap 10 is filled with a slurry or paste having the same dielectric constant as the dielectric components being joined. If these dielectric constants cannot be made identical, they should be as nearly alike as practically possible. Having an essentially unchanged dielectric constant from one dielectric component, through the joint and into the other dielectric component, results in the transfer of the electromagnetic millimeter wave energy essentially as if no joint or discontinuity exists, thereby eliminating or minimizing the insertion loss which otherwise occurs because of radiation or reflection of the energy.

In one embodiment which has been built and tested, dielectric waveguides 12 and 14 were fabricated from magnesium titanate having a dielectric constant of $\epsilon'=16$. In accordance with the invention, a slurry or paste was made by mixing fully reacted barium titanate, which has a dielectric constant $\epsilon'=38$, with cellulose nitrate, which has a dielectric constant $\epsilon'\approx2$. Two parts by weight of barium titanate were mixed with one part by weight of the cellulose nitrate, to provide an effective dielectric constant for the mixture which was similar to that of the dielectric waveguides. The air gap is filled with the mixture and the mixture is cured by drying, heating, etc.

The cellulose nitrate adhesive and sealing compound is commercially available as a product of Steven Industries. Similar results may be effected using an epoxy adhesive such as Scotch-Weld 2290 which is available from 3 M.

In general, an inorganic dielectric and an organic binder are combined in proportions appropriate to yield a composite dielectric constant the same as, or similar to, that of the dielectric components being joined. In the case of dielectric millimeter wavelength waveguides and components, dielectric constants (permittivities) range from $\epsilon'=2$ to $\epsilon'=16$. The permittivity of the dielectric waveguide is the parameter which tends to cause retention of the millimeter wave energy which is being transmitted, since the permittivity of air ($\epsilon'=1$) is lower than that of the dielectric millimeter waveguide.

Referring again to FIG. 2, the high ($\epsilon'=16$) dielectric constant waveguides are shown mounted on a low permittivity supporting substrate 16 (Rexolite $\epsilon'=2.5$). Because the Rexolite is a low loss dielectric material having low permittivity, it does not interfere with the transmitted wave, but will give rigidity and support to the dielectric waveguides and other dielectric waveguide circuit elements.

Figure 3:
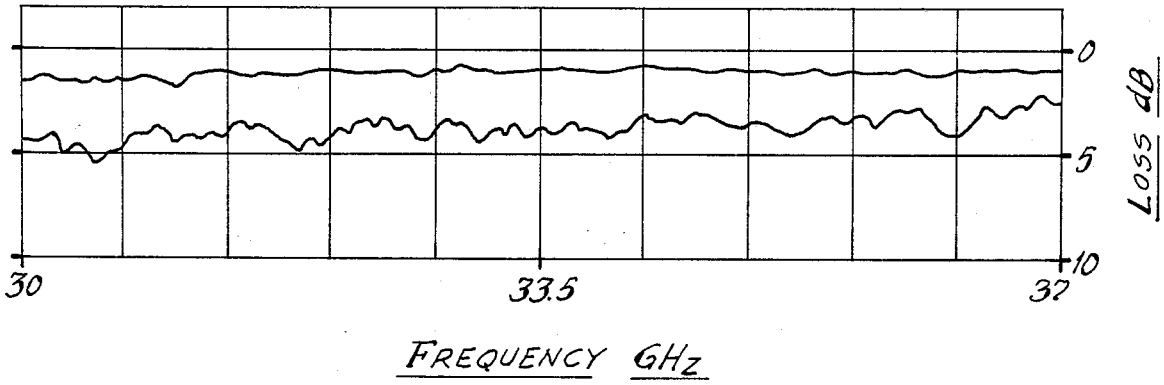
FIG. 3 represents insertion loss measurements of the FIGS. 1 and 2 structures.

The results of insertion loss measurements over a frequency range of 30 GHz to 37 GHz are represented in FIG. 3. The lower curve is that for the unfilled gap (0.004 inches wide) waveguide section (FIG. 1) which yielded approximately 4 dB loss (60% of the power being lost). When the air gap was filled (FIG. 2) as described above, the configuration yielded a significantly improved insertion loss (upper curve) of approximately 1 dB (21% of the power being lost). Hence, the invention provides a 65% improvement in insertion loss reduction. (It should be noted that both insertion loss measurements were made with the two waveguides mounted on the dielectric support shown in FIG. 2).

Although a particular embodiment of a low loss dielectric waveguide joint has been illustrated and described, it will be obvious that changes and modifications can be made without departing from the spirit of the invention and the scope of the appended claims.

We claim:

1. A low loss joint between millimeter wavelength, dielectric components comprising:

a first longitudinal section of a magnesium titanate dielectric waveguide transmission line having a predetermined cross section, a second longitudinal section of a magnesium titanate dielectric waveguide transmission line of the same cross section and dielectric material, said first and second sections having respective opposing ends aligned and closely spaced in a transverse butt joint, and a curved mixture of an barium titanate inorganic dielectric and an cellulose nitrate organic binder filling the space between said ends and solidly joining said sections, said mixture having a dielectric constant substantially the same as said two sections and wherein said filled joint provides a 65 percent improvement in insertion loss reduction.

2. A low loss joint between millimeter wavelength, dielectric components in accordance with claim 1 wherein:

said mixture is, by weight, two parts barium titanate to one part cellulose nitrate.

3. The device of claim 1 wherein said dielectric waveguides have a rectangular cross section.

4. The device of claim 3 including a base support of dielectric material having a low permittivity, said waveguide sections being mounted on said support.

5. A method of fabricating a low loss joint between millimeter wavelength, magnesium titanate dielectric components so that a 65 percent improvement in insertion loss reduction is provided, said method comprising:

preparing a slurry of an barium titanate inorganic dielectric and an cellulose nitrate organic binder;

placing said slurry in the joint between said barium titanate dielectric components; and curing the slurry.

6. A method of fabricating a low loss joint between millimeter wavelength, dielectric components in accordance with claim 5 wherein:

said inorganic dielectric and said organic binder are taken in such proportions that the dielectric constant of the slurry is the same as that of said dielectric components.

7. A method of fabricating a low loss joint between millimeter wavelength, dielectric components in accordance with claim 5 wherein:

said slurry is, by weight, two parts barium titanate to one part cellulose nitrate.

* * * * *